United States Patent [19]

Kai et al.

[11] Patent Number: 4,660,705

[45] Date of Patent: Apr. 28, 1987

[54] COIN DISCRIMINATION APPARATUS

[75] Inventors: Osamu Kai, Tokyo; Takashi Oyamada, Kanagawa; Shin Iwabuchi, Tokyo, all of Japan

[73] Assignee: Tamura Electric Works, Ltd., Tokyo, Japan

[21] Appl. No.: 738,124

[22] Filed: May 24, 1985

[30] Foreign Application Priority Data

Jun. 8, 1984 [JP] Japan ..... 59-116624

[51] Int. Cl.[4] ..... G07D 5/08

[52] U.S. Cl. ..... 194/318; 194/334

[58] Field of Search ..... 194/318, 317, 319, 217, 194/218, 334; 73/163; 364/479

[56] References Cited

U.S. PATENT DOCUMENTS 3,918,565 11/1975 Fougere et al. ..... 194/317
4,349,095 9/1982 Lewis ..... 73/163 X
4,436,196 3/1984 Crisp et al. ..... 194/318
4,493,411 1/1985 Heiman ..... 73/163 X
4,509,633 4/1985 Chow ..... 73/163 X

*Primary Examiner*—F. J. Bartuska
*Attorney, Agent, or Firm*—Townsend & Townsend

[57] ABSTRACT

A coin discrimination apparatus has: detecting circuitry for detecting as an electrical signal a physical characteristic of a coin; an analog-to-digital converter for converting an output of the detecting circuitry to a digital signal; and a memory device for receiving as an address signal the digital signal generated from the analog-to-digital converter and for storing a binary signal of a plurality of bits for discriminating the physical characteristic in bit positions corresponding to a denomination of the coin at each address for each of the physical characteristics. The memory device is accessed by the digital signal from the analog-to-digital converter as a read signal and allows readout of the accessed content as a signal representing authenticity of the coin.

16 Claims, 12 Drawing Figures

COIN DISCRIMINATION APPARATUS

BACKGROUND OF THE INVENTION

The present invention relates to a coin discrimination apparatus for discriminating coins inserted in an automatic vending machine or a public telephone set.

A conventional coin discrimination apparatus is disclosed in U.S. Pat. No. 3,918,565 issued on Nov. 11, 1975. According to this apparatus, physical characteristics such as the thickness and outer diameter of a coin are detected as electrical signals by a detector. At the same time, upper and lower limit values corresponding to the detection signals of the physical characteristics are stored in a memory. The upper and lower limit values are compared with the detection values, respectively, thereby discriminating authenticity and denomination of the coin.

According to this conventional technique, data representing the upper and lower limit values of the physical characteristics of coins corresponding to the denominations must be read out from the memory, and all the readout data must be compared with the corresponding detection signals, thus failing to achieve high-speed operation and increasing power consumption. In addition, when the above operations are performed by a processor, a program is complicated, and a time margin for other control operations is decreased. Since high-speed discrimination cannot be performed, the discrimination time is increased to limit the time interval for coin insertion. The coin path design is limited, resulting in inconvenience.

SUMMARY OF THE INVENTION

It is a principal object of the present invention to provide a coin discrimination apparatus for discriminating authentic and counterfeit coins at high speed in accordance with a simplified program as compared with a conventional program.

It is another object of the present invention to provide a coin discrimination apparatus for decreasing design restrictions of coin processing.

It is still another object of the present invention to provide a coin discrimination apparatus which economizes power consumption for coin discrimination.

In order to achieve the above objects of the present invention, there is provided a coin discrimination apparatus comprising: detecting means for detecting as an electrical signal a physical characteristic of a coin; an analog-to-digital converter for converting an output of the detecting means to a digital signal; and a memory device for receiving as an address signal the digital signal generated from the analog-to-digital converter and for storing a binary signal of a plurality of bits for discriminating the physical characteristic in bit positions corresponding to a denomination of the coin at each address for each of the physical characteristics wherein the memory device is accessed by the digital signal from the analog-to-digital converter as a read signal and allows readout of the accessed content as a signal representing authenticity of the coin.

DESCRIPTION OF THE PREFERRED EMBODIMENT

The present invention will be described in detail with reference to the preferred embodiment of the present invention.

Figure 1:
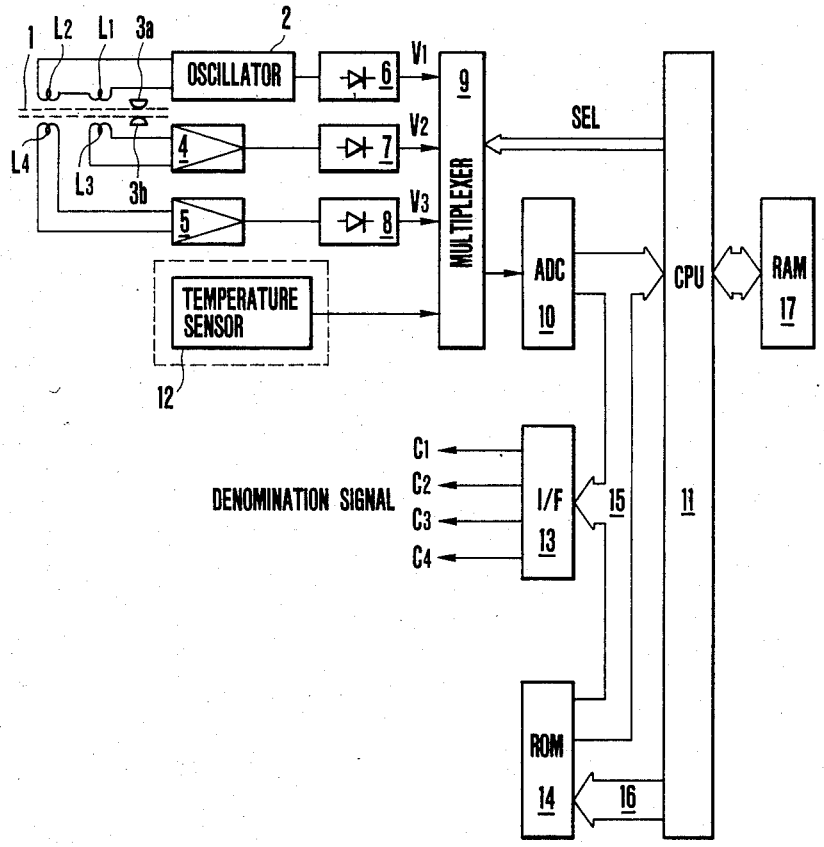
FIG. 1 is a block diagram of a coin discrimination apparatus according to an embodiment of the present invention.

FIG. 1 is a block diagram of a coin discrimination apparatus of the embodiment. Oscillating coils L1 and L2 and receiving coils L3 and L4 are arranged to oppose each other through a coin path 1. An oscillator 2 is connected to the coils L1 and L2 which oscillate at a predetermined frequency to generate magnetic flux. Magnetic fields generated by the coils L1 and L2 are detected by the coils L3 and L4, respectively.

Detectors 3*a* and 3*b* as a combination of a light-emitting element and a light-receiving element are arranged near the inlet port of the path 1. The detectors 3*a* and 3*b* detect insertion of a coin to generate a start instruction to the respective parts.

The coils L3 and L4 are connected to amplifiers 4 and 5, respectively. The outputs from the oscillator 2 and the amplifiers 4 and 5 are detected by rectifiers 6 to 8, respectively. A multiplexer 9 selects a detection signal, and a multiplexed signal is supplied to an ADC 10. The ADC 10 converts an analog signal to an 8-bit digital signal. The digital signal is supplied to a processor (to be referred to as a CPU) 11 such as a microprocessor.

When the coin is inserted and rolling along the path 1, the outputs from the oscillator 2 and the amplifiers 4 and 5 are changed in accordance with a material, a thickness and an outer diameter of the coin. The outputs from the rectifiers 6 to 8 are accordingly changed. Among the outputs converted by the ADC 10, a peak value of the output from the rectifier 6 is discriminated by the CPU 11 which has a peak value discrimination function, thereby obtaining data representing the material of the coin. The CPU 11 also discriminates a peak value of the output from the rectifier 7 to obtain data representing the thickness of the coin. The CPU 11 detects a crossing point between the outputs from the rectifiers 7 and 8 to detect the outer diameter of the coin. The discrimination of the material, thickness and outer diameter of the coin will be described in detail with reference to FIGS. 2 to 7.

An output from a temperature sensor 12 arranged near the coils L1 to L4 as needed is supplied to the multiplexer 9. The inputs to the multiplexer 9 are sequentially or repeatedly selected in response to a selection signal SEL supplied from the CPU 11. The selected signal is supplied to the CPU 11 through the ADC 10. The CPU 11 is connected to an I/O interface (to be referred to as an I/F) 13 and a ROM (read-only memory) 14 through a data bus 15. The CPU 11 selectively supplies denomination signals C1 to C4 each representing a coin discrimination result to the ROM 14 through the I/F 13. The contents of the ROM 14 are read out in response to an address access signal supplied from the CPU 11 through an address bus 16.

The ROM 14 stores a program and a signal representing coin physical characteristic reference values. The coin discrimination apparatus also has a RAM (random access memory) 17. The CPU 11 executes the program stored in the ROM 14 and performs a predetermined operation while accessing necessary data in the RAM 17.

Figure 2:
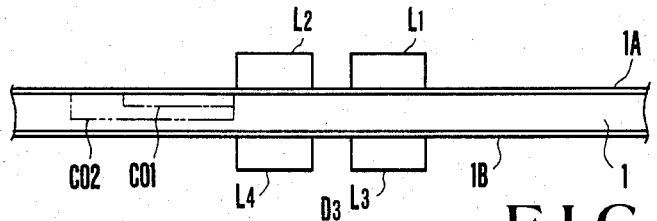
FIG. 2 is a plan view showing a coin path of the apparatus of FIG. 1.
Figure 3:
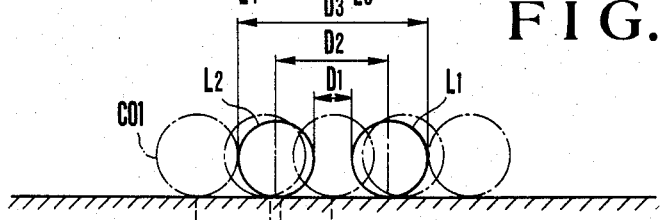
FIG. 3 is a front view showing a state wherein a small-diameter coin passes through the coin path of FIG. 2.

Referring to FIG. 2, the coil L2 has the same construction as the coil L1. The coils L1 and L2 are arranged on a coin contact surface 1A of the inclined coin path 1 therealong at a predetermined interval. The coils L3 and L4 having the identical construction are arranged on a coin noncontact surface 1B of the path 1 therealong so as to oppose the coils L1 and L2, respectively. The coils L2 and L1 are connected in series with each other to the oscillator 2 so as to generate oscillation magnetic fields, respectively. Signal frequencies of the magnetic fields are low enough to cause the magnetic fluxes to pass through coins CO1 and C02. The output from the oscillator 2 is rectified by the rectifier 6 to obtain an output voltage V1 having a waveform I in FIGS. 4 or 6.

Impedance (inductance) of the oscillation coils changes while the coin passes through the path. The change in impedance (inductance) depends on the coin material. Maximum output voltages V11 and V11′ (of the output voltage V1 from the rectifier 6) at times t1 and t1′ upon passage of the coins C01 and C02 are compared with corresponding values for authentic coins, and thus material discrimination is performed. The output voltage V1 is converted by the ADC 10 to digital data which is supplied to the CPU 11. The digital data is then temporarily stored in a register of the CPU 11 or the RAM 17. The ROM 14 prestores the output ranges for the authentic coins. The CPU 11 compares the detection data with the data read out from the ROM 14 to discriminate the authenticity of the coin. The peak width of the output voltage V1 for the large-diameter coin is larger than that of the small-diameter coin. In other words, condition $T2<T240$ is established.

The outer diameter of the coin is discriminated by outputs from the coils L4 and L3. The outputs from the coils L4 and L3 are amplified by the amplifiers 4 and 5 and rectified by the rectifiers 7 and 8, respectively, to obtain output voltages V2 and V3 having waveforms II and III in FIGS. 4 or 6. Output voltages V2 and V3 derived when changes in impedance of the coils are the same at times t3 and t3′ (i.e., the coin is located at the midpoint between the coils L1 and L2) are small if the outer diameter of the coin is increased. However, when the outer diameter of the coin is decreased, the output voltage V2 (=V3) is increased. This is because an influence of the coin location on the impedance of the coil L3 or L4 is maximum when the coin is located at the center of the coil L3 or L4. When the coin is moved away from the center of the coil L3 or L4, the influence is decreased. In this case, when the outer diameter is large, a large influence is obtained even if the coin is moved away from the center of each coil L3 or L4. Therefore, the waveforms II and III cross each other at a relatively low voltage level. However, when the outer diameter is decreased, the influence of coin location is rapidly weakened when the coin is moved away from the center of the coil L3 or L4, so that the intersection between the waveforms II and III is moved upward to a relatively high voltage level.

The output voltages V23 and V23′ at intersections between the waveforms II and III are compared with the corresponding data, respectively, thereby discriminating the coin.

Figure 4:
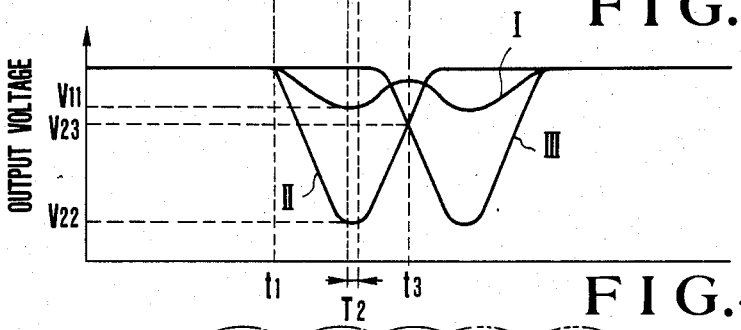
FIG. 4 is a timing chart of a detection signal derived when the small-diameter coin passes through the coin path.
Figure 5:
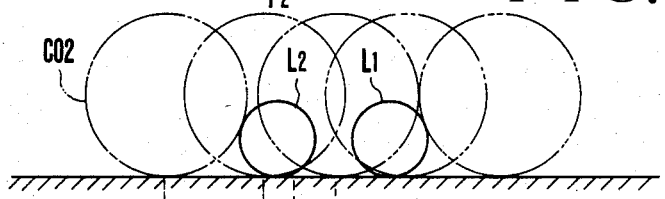
FIG. 5 is a front view showing a state wherein a large-diameter coin passes through the coin path of FIG. 2.
Figure 6:
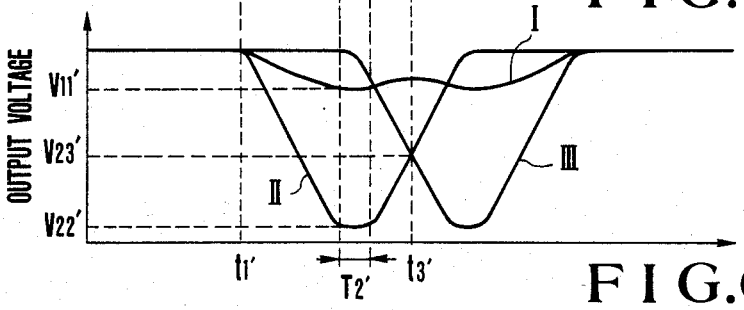
FIG. 6 is a timing chart of a detection signal derived when the large-diameter coin passes through the coin path.

As is apparent from FIGS. 4 and 6, the outer diameter can be discriminated in accordance with a voltage level (of the output voltage V1 from the coil L1 or L2) corresponding to a valley (peak value) of the double peak curve I. In this case, a possible detection range of the outer diameter D is given as $D1<D\leqq D2$ where D1 is a distance between the coils L1 and L2 and D2 is the distance between the centers of the coils L1 and L2. This is because the above-mentioned output voltage levels will not coincide with each other unless the coin located at the midpoint between the coils L1 and L2 overlaps both the coils L1 and L2. However, when the diameter of a coin is excessively large, the peak value (i.e., the valley in the double peak curve I) of the impedance change cannot be detected.

When the peak value is detected by the intersection between the output voltages V2 and V3 from the coils L3 and L4, the lower limit of the possible detection range of the outer diameter D of the coins is the same as that described above. However, the upper limit can be increased to satisfy condition $D\leqq D3$ where D3 is the distance between farthest points of the coils L3 and L4, resulting in convenience.

The size of the coil L3 (or the coil L1) need not be the same as that of the coil L4 (or the coil L2). Even if the sizes of the coils L3 and L4 (or the coils L1 and L2) differ from each other, various techniques can be utilized to perform coin discrimination. In this case, the intersection between the outputs does not coincide with the midpoint between the coils. The output voltages at the intersection can be changed in accordance with changes in outer diameter of the coil, thereby performing outer diameter discrimination. However, the coils preferably have the same construction as described above to achieve a simple structure of the coin discrimination apparatus as a whole.

The thickness of the coin can be discriminated by the voltage V2 or V3 from the coil L3 or L4. The changes in impedance of the coil L3 or L4 upon passage of the coin through the path are increased when the coin has a large thickness. The maximum-change output voltages V22 and V22′ (of the output voltage V2 from the coil L3) are converted by the ADC 10 to digital data which are then compared with the reference thickness data stored in the ROM 14, thereby discriminating the thickness of the coin.

Figure 7:
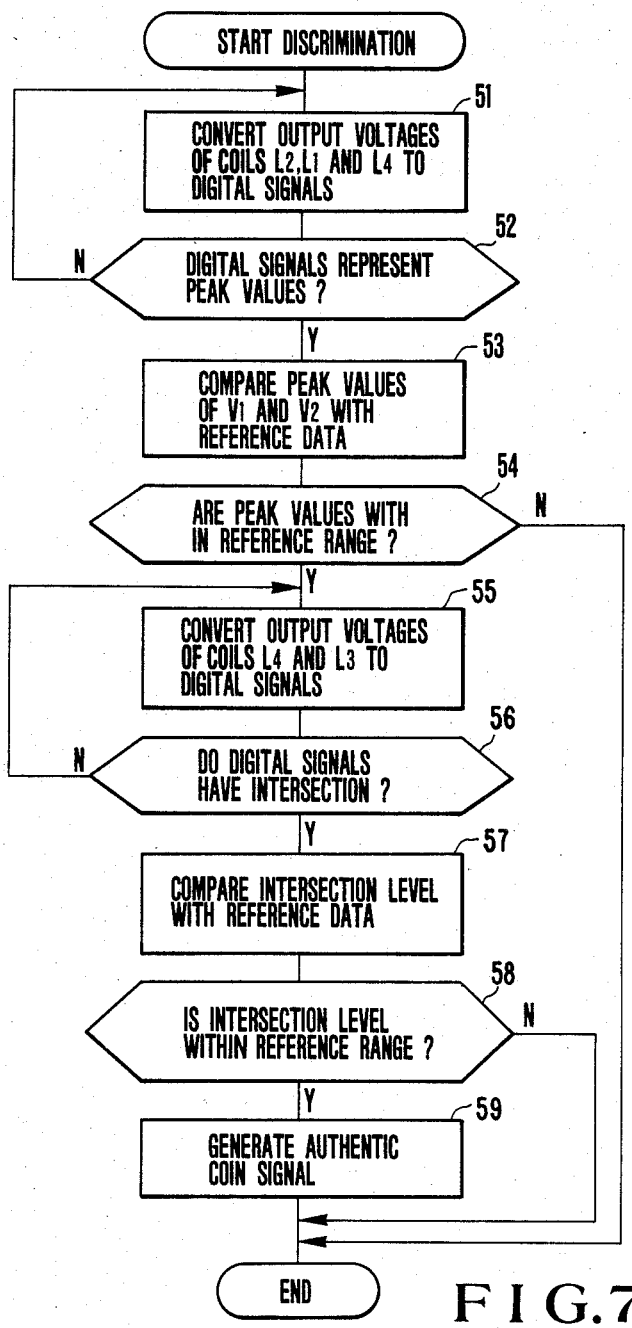
FIG. 7 is a flow chart for explaining the control operation of a CPU.

The coin discrimination operation of the apparatus having the arrangement described above will be described with reference to the flow chart of FIG. 7.

The output voltage V1 of the coils L2 and L1 and the output voltage V2 of the coil L4 are converted to digital data (step 51). When peak values (minimum values) of the respective coils are detected (step 52), they are compared with the preset data stored in the ROM (step 53). When the detected peak values fall within the reference range (step 54), the output voltages V2 and V3 of the coils L4 and L3 are converted to digital data (step 55). When an intersection between the output voltages V2 and V3 is detected (step 56), the level represented by the intersection is compared with reference data (step 57). When the detected level falls within the reference range (step 58), an authentic coin signal S is generated (step 59) to complete coin discrimination.

When the coins to be discriminated are classified into a plurality of denominations, the data representing the possible output ranges of material, outer diameter and thickness of authentic coins in units of denominations are stored in the ROM 14. When an output representing the material and the thickness of an inserted coin falls within the range for the first denomination, the output representing the outer diameter is discriminated as to whether or not the output falls within the reference range for the first denomination, thereby discriminating the denomination and authenticity.

Figure 8:
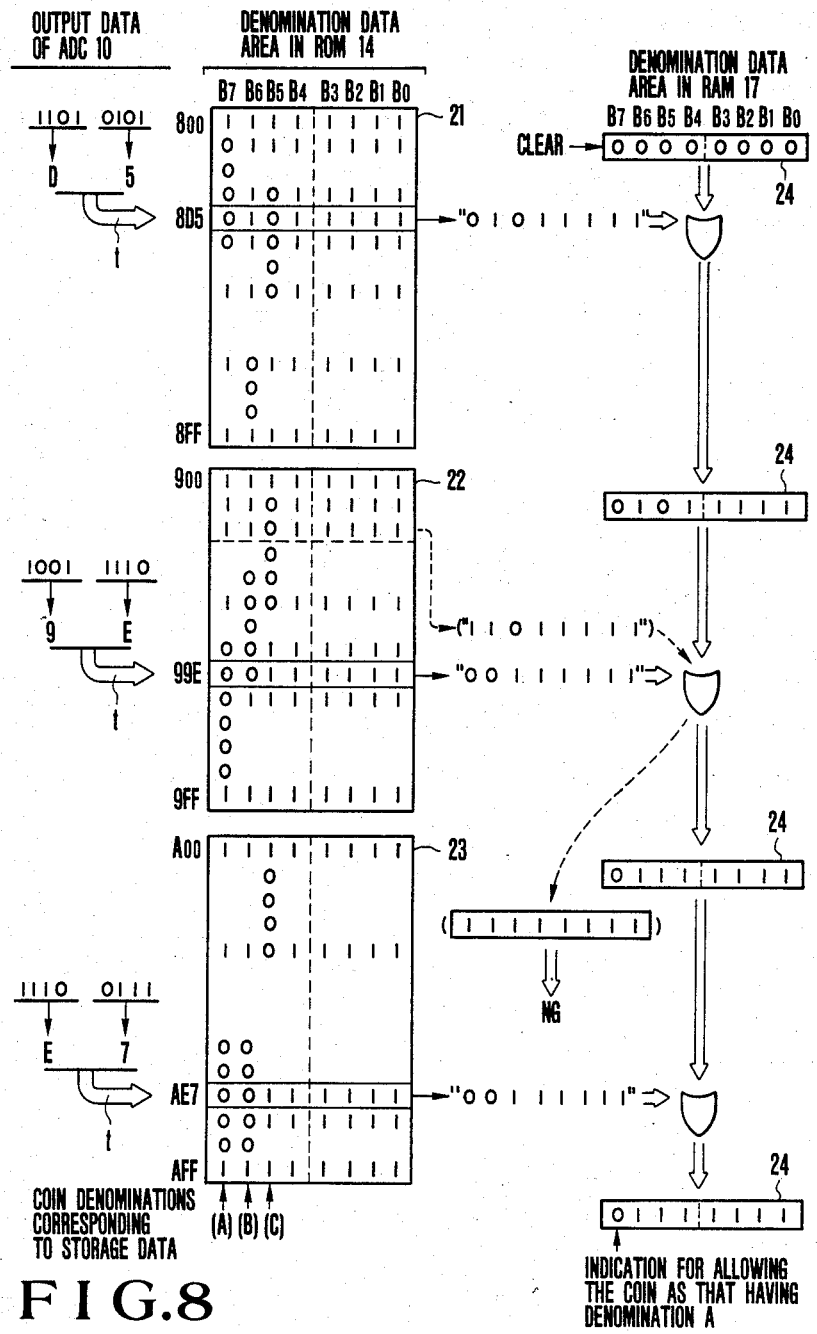
FIG. 8 is a data table showing the contents of a ROM and a denomination data area.

FIG. 8 shows the contents of the ROM 14 and the denomination data area of the RAM 17. In this case, addresses 800 to 8FF in the ROM 14 are assigned to a material block 21, addresses 900 to 9FF are assigned to a thickness block 22, and addresses A00 to AFF are assigned to an outer diameter block 23. Bits B7 to B5 of bits B7 to B0 of data stored at each address correspond to denominations A to C of the coins, respectively. Data of logic "0" is stored at an address accessed by each physical characteristic detection data. A signal of logic "0" is also stored at an address range accessed by the detection data derived in accordance with an allowable change in each physical characteristic.

Since the allowable change in the material and thickness data partially overlaps even if the denominations A to C of the coins vary in the blocks 21 and 22, the signals of logic "0" also overlap in the blocks 21 and 22. The same signal of logic "0" is used in the block 23 since the outer diameter allowable change for the denomination A is the same as that for the denomination B.

Among the output data of the ADC 10 which respectively correspond to the coils L1 to L4 as the detectors, the material data which is obtained by the CPU 11 accesses the read address of the block 21. The thickness data accesses the read address of the block 22. Similarly, the outer diameter data accesses the read address of the block 23. The data at the accessed addresses of the ROM 14 are read out and fetched to the CPU 11.

When the output from the ADC 10 comprises 8-bit data, the lower two hexadecimal digits of each of the addresses 800 to AFF, and the most significant hexadecimal digits "8", "9" and "A" of the addresses are assigned by the CPU 11 to the blocks 21 to 23, respectively. These most significant hexadecimal digits are sequentially accessed through the address bus 16.

When the material data, the thickness data and the outer diameter data are respectively given as $D5_{hex}$ (i.e., "11010101" in binary notation), $9E_{hex}$ (i.e., "10011110"), and $E7_{hex}$ (i.e., "11100111"), respectively, the addresses 8D5, 99E and AE7 are accessed in the blocks 21 to 23, respectively. The data "01011111", "00111111" and 00111111" stored at the addresses 8D5, 99E and AE7 are sequentially read out from the blocks 21 to 23. All data stored in a denomination data area 24 of the RAM 17 are cleared to logic "0". The contents of the denomination data area 24 is logically ORed with the contents of the block 21. The resultant data is stored in the denomination data area 24. The similar OR product between the contents of the area 24 and the block 22 is calculated and stored in the area 24. Similarly, an OR product between the contents of the area 24 and the block 23 is calculated and stored in the area 24. In the case described above, all the bits B7 of the blocks 21 to 23 are set at logic "0", so that the bit B7 of the denomination data area 24 is set at logic "0", thereby indicating that the inserted coin is detected to have the denomination A and physical characteristics for the denomination A.

The resultant data is sent as the denomination signals C1 to C4 concerning the denomination A through the decoder or the like, and the denomination of the inserted coin can be immediately discriminated.

However, when an erroneous address of the block 22 is accessed to read out data "11011111" given in parentheses, the content of the denomination data area 24 is "11111111" so that logic "0" disappears. In this case, the inserted coin is discriminated as a counterfeit coin, and a signal NG is generated.

Figure 9:
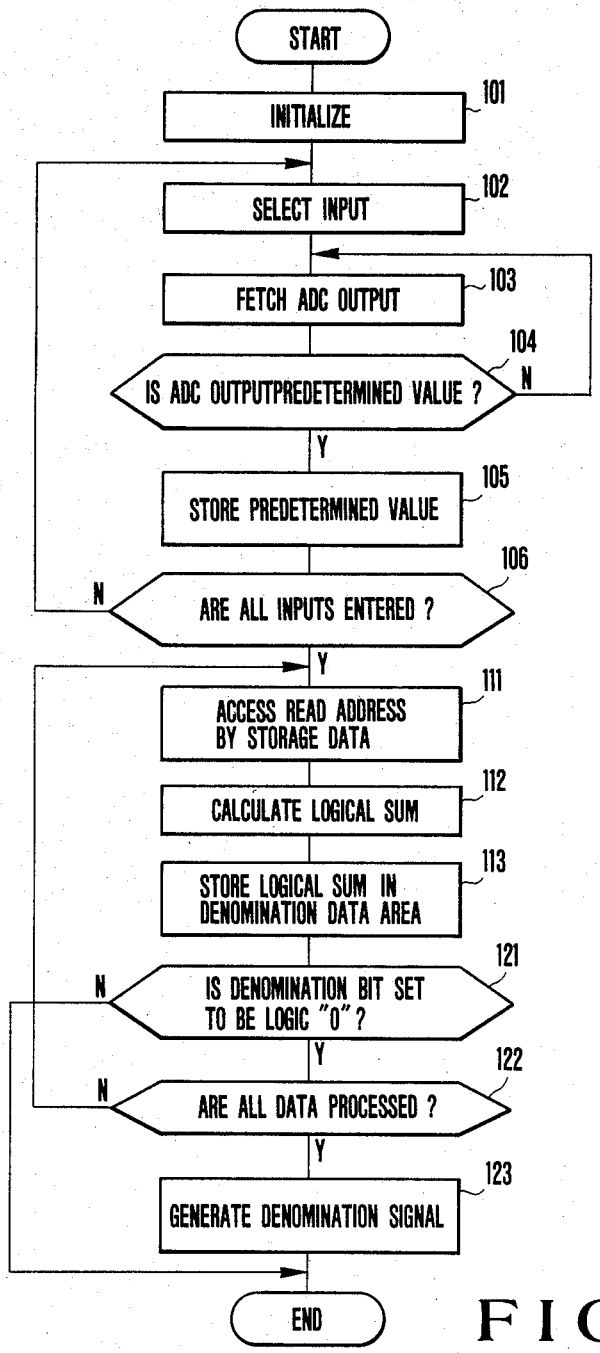
FIG. 9 is a flow chart for explaining the operation of the CPU.

FIG. 9 is a flow chart for explaining the operation of the CPU 11 as described above. After "START", initialization is performed in step 101, input selection in step 102 of the multiplexer 9 is performed in accordance with the selection signal SEL. ADC output fetching is performed in step 103. If YES in step 104, i.e., the CPU determines that the peak value or intersection value is given as a predetermined value, the output data from the ADC 10 is stored in the RAM 17, and the peak value or intersection value is stored in step 105. If NO in step 106, i.e., the CPU determines that the all input operations of the multiplexer 9 are not completed, the operations after step 102 are repeated. However, if YES in step 106, the address is accessed by the readout data in step 111. The OR product is calculated in step 112 and is stored in the denomination data area of the RAM 17 in step 113.

If YES in step 121, i.e., the CPU 11 determines that the bit of "0" is present in the denomination data area, the operations after step 111 are repeated while the step 122 is discriminated as NO, i.e., while the CPU 11 determines that all the data processing is not completed. When YES in step 122, the denomination signal is generated in step 123.

Figure 10:
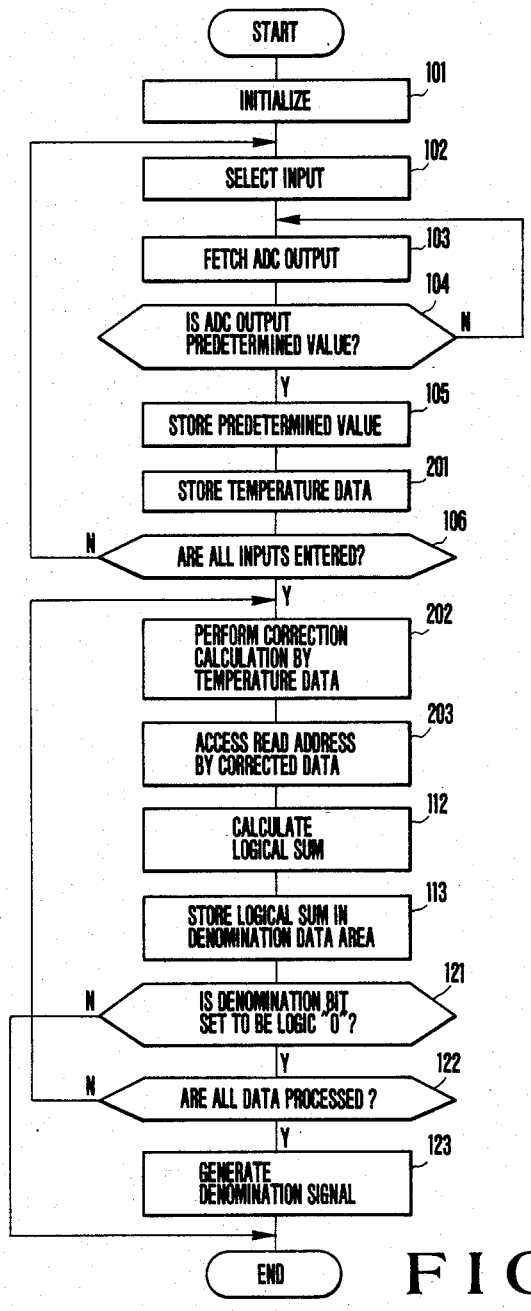
FIG. 10 is a flow chart for explaining the operation of the CPU in the same manner as in FIG. 9 when temperature correction is performed.

FIG. 10 is a flow chart for explaining the operation of the CPU 11 which includes the operation wherein the detected physical characteristics are corrected in accordance with the output from the temperature sensor 12 of FIG. 1. In step 201, the temperature data is stored after the same step 105 as in FIG. 9 is performed. After performing the same step 106 as in FIG. 9, correction operation by the temperature data is performed in step 202, thereby correcting the data obtained by the step 105. The address is accessed in response to the corrected data in step 203.

The subsequent operations are the same as in FIG. 9.

Figure 11:
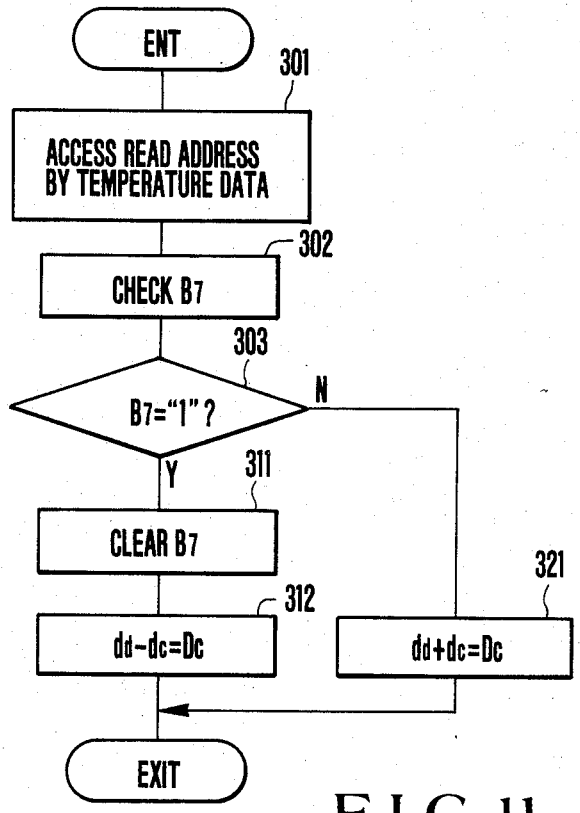
FIG. 11 is a flow chart showing a subroutine of step 202 of the main routine of FIG. 10.

FIG. 11 is a subroutine of step 202 of FIG. 10. In this case, a temperature correction data area is assigned in the ROM 14. Data of "1" representing an addition or "0" representing a subtraction is stored in the bit B7 at each address. The correction data is stored at positions of bits B6 to B0 and is stored in a memory area corresponding to each of the blocks 21 to 23 of FIG. 8.

For this reason, the correction data is read out from the predetermined block upon accessing of the address by the temperature data in step 301. The B7 bit of the readout data is checked in step 302. The CPU 11 checks in step 303 whether or not condition B7=1? is established. If YES in step 303, the bit B7 is cleared to logic "0" in step 311. The correction data dc is subtracted from the physical characteristic detection data dd (dd−dc=Dc) in step 312, thereby obtaining the corrected data Dc.

However, if NO in step 303, the correction data Dc is obtained such that dd+dc=Dc in step 321.

The coin discrimination operation is performed to determine which denomination coincides with that of the inserted coin by simultaneous memory access on the basis of the data obtained by the inserted coin. Therefore, unlike the conventional case wherein the detected physical characteristics of each coin are compared with the reference values, the coin discrimination time can be greatly decreased. In addition, the program can be much simplified.

Figure 12:
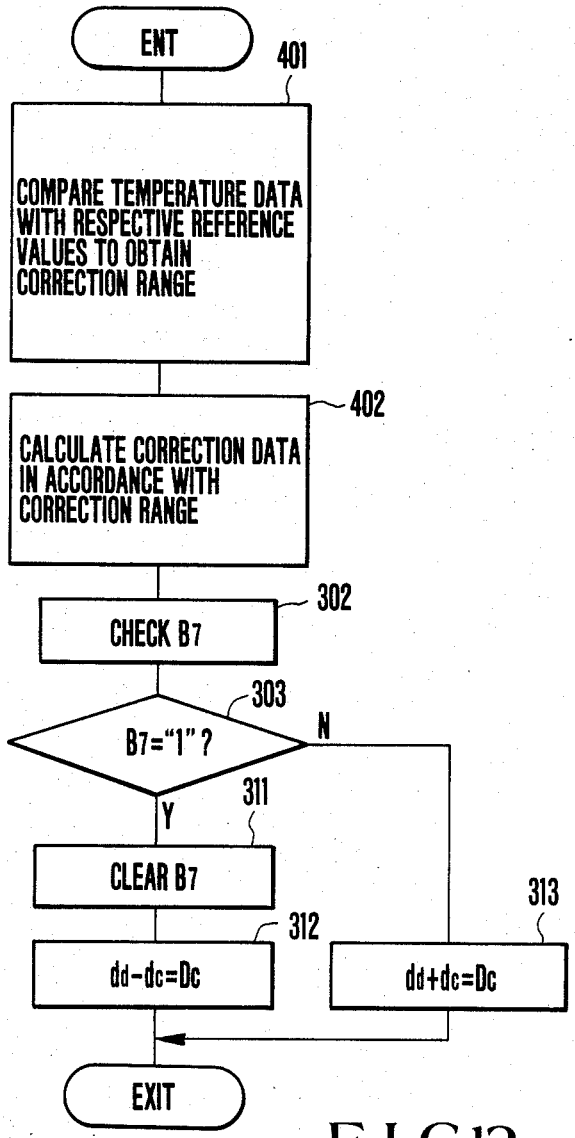
FIG. 12 is a flow chart showing another subroutine of step 202 in accordance with another control scheme.

FIG. 12 is a subroutine for explaining the operation of FIG. 11 in accordance with another scheme. In this case, a reference value area and a correction data area are formed in the ROM 14. The reference values are sequentially read out from the reference value area and compared with the temperature data to obtain a correction range in step 401. The address of the correction data area is accessed by the correction range data to obtain the correction data corresponding to the correction range in step 402. The subsequent operations are the same as those in FIG. 11.

The CPU 11 mainly performs the operations in FIGS. 8 and 9. The output data of the ADC 10 which is selected as the value representing the physical characteristics of the coin can be used without modifications. By using this data, the addresses of the blocks 21 to 23 in the RAM 14 can be accessed. In this case, the readout data directly represents the authenticity and denomination of the coin. In this manner, the coin discrimination program can be further simplified and the processing time can be shortened.

Only a single physical characteristic may be used in the embodiment. In this case, an OR product need not be calculated. However, in the embodiment as described above, when a plurality of physical characteristics are prepared, an OR product must be calculated.

In the description after FIG. 10, when correction is performed by the detection signal from the temperature sensor 12, the discrimination result can be more accurate. Changes in detection outputs due to temperature characteristics of the coin, the coils L1 to L4 and the rectifiers 6 to 8 can be cancelled. Correction by temperature data can be omitted in a given condition free from temperature changes.

Since the processing time of the CPU 11 can be shortened, power consumption can be decreased, and coins can be continuously inserted. In addition, coin path design restrictions can be eased, and a time margin for performing other control operations can be guaranteed.

In a public telephone set of a station power source system wherein a capacitor is charged with a line current derived from a switch board power source and a capacitor terminal voltage is used as a station power source, power consumption required for coin discrimination can be decreased to easily repeat continuous discrimination operations. By such high-speed discrimination, the function of the processor 11 which controls other processing functions can be easily improved.

Denominations and physical characteristics of coins to be discriminated can be arbitrarily selected in accordance with given circumstances. The number of blocks and bit positions of FIG. 8 and the type of detector are determined in accordance with the given denominations and physical characteristics. The signal for discriminating the coin is not limited to logic "0" but can be replaced with logic "1" or a combination of a plurality of bits. When a plurality of bits are used, a logical product can be obtained. Any temperature correction means can be used. Various changes and modifications may be made within the scope and spirit of the invention.

As is apparent from the above description, high-speed discrimination processing can be performed with a simple arrangement. The discrimination processing time is shortened resulting in decreased power consumption. Various restrictions can be eliminated to obtain various effects in apparatuses such as automatic vending machines and public telephone sets which require insertion of coins.

What is claimed is:

1. A coin discrimination apparatus comprising: detecting means for detecting as an electrical signal a physical characteristic of a coin; an analog-to-digital converter for converting an output of said detecting means to a digital address signal; a memory device for receiving said address signal from said analog-to-digital converter and for storing a multi-bit binary signal for discriminating said physical characteristic in bit positions corresponding to a denomination of the coin at each address for each of the physical characteristics; and discriminating means for determining the authenticity of the coin from the bit position values of the multi-bit signal read from said memory device by said address signal, wherein said memory device is accessed by the digital address signal from said analog-to-digital converter as a read signal and allows readout of the accessed content as a signal representing authenticity of the coin.

2. An apparatus according to claim 1, which further comprises means for temporarily storing the address signal output from said analog-to-digital converter.

3. An apparatus according to claim 1, wherein said detecting means has a plurality of detectors for detecting as electrical signals different physical characteristics of the coin, said analog-to-digital converter converts the outputs generated from said detectors to digital address signals, and said memory device comprises a plurality of memories for receiving the digital address signals from said analog-to-digital converter corresponding to said detectors, respectively, each of said memories being arranged to store a multi-bit binary signal in bit positions corresponding to a denomination of the coin at address for each of the physical characteristics, the binary signal being arranged to discriminate the physical characteristic, and wherein said discriminating means further comprises means for calculating an allowable bit-by-bit logical coincidence between contents selectively read out from said memories and generating the binary signal representing the physical characteristic of the coin.

4. An apparatus according to claim 3, wherein each of said plurality of memories comprises a single memory unit, to which an upper address for each physical characteristic is assigned as an address.

5. An apparatus according to claim 1, wherein said detecting means comprises one magnetic flux generating coil and one receiving coil which are arranged to oppose each other through a coin path, means for supplying an alternating signal to said oscillating coil, and means for rectifying an output from said receiving coil, an output from said rectifying means being used as a detection output.

6. An apparatus according to claim 1, wherein said detecting means comprises an electromagnetic coil for generating an electrical signal corresponding to a change in impedance thereof.

7. An apparatus according to claim 6, wherein said detecting means comprises current means for extracting a direct current electrical signal from an alternating current electrical signal.

8. An apparatus according to claim 1, wherein said detecting means comprises peak value detecting means for detecting a peak value of the electrical signal.

9. An apparatus according to claim 1, wherein said detecting means detects a change in frequency of the electrical signal.

10. An apparatus according to claim 1, wherein said detecting means comprises one magnetic flux generating coil arranged along a coin path to receive an alternating signal, first and second receiving coils arranged on a coin path wall to oppose said one magnetic flux generating coil at a predetermined interval along the coin path, and which further comprises coin material detecting means for detecting a coin material signal from the outputs of said magnetic flux generating coil when the coin passes through the coin path, and means for detecting a coin thickness signal from an output for one of said receiving coils when the coin passes through the coin path.

11. An apparatus according to claim 10, which further comprises means for detecting outer diameter data from outputs of said first and second receiving coils.

12. An apparatus according to claim 10, which further comprises means for detecting an outer diameter of the coin in accordance with a change in output from said one magnetic flux generating coil.

13. An apparatus according to claim 1, which further comprises means for correcting the detected physical characteristic signal.

14. An apparatus according to claim 13, wherein said correcting means comprises a temperature sensor for detecting an ambient temperature and means for correcting the address signal supplied to said memory device in accordance with temperature data derived from an output of said temperature sensor.

15. An apparatus according to claim 14, wherein said correcting means comprises a correction data memory for receiving a correction address signal corresponding to the output generated from said temperature sensor and for storing correction polarity and correction data of a plurality of bits in correspondence with a change in temperature at each address of said correction data memory, the address signal to be supplied to said memory device and corresponding to measured data of the coin being corrected by an output from said correction data memory.

16. An apparatus according to claim 13, wherein said correcting means comprises means for sequentially comparing the output from said temperature sensor with one of reference values determined by a plurality of temperature gradients, means for discriminating which correction range defined by successive reference values includes the output from said temperature sensor, and means for outputting corrected data corresponding to a discriminated correction range, the address signal to be supplied to said memory device and corresponding to measured data of the coin being corrected in accordance with the corrected data.

* * * * *